US006467135B1

(12) United States Patent
Schuster et al.

(10) Patent No.: US 6,467,135 B1
(45) Date of Patent: Oct. 22, 2002

(54) SECURITY ZIPPER PULL

(75) Inventors: Mark Schuster; Glenn Rodgers, both of San Francisco; David Pitcher, Menlo Park, all of CA (US)

(73) Assignee: Acco Brands Inc., Lincolnshire, IL (US)

( * ) Notice: Subject to any disclaimer, the term of this patent is extended or adjusted under 35 U.S.C. 154(b) by 0 days.

(21) Appl. No.: 08/970,892

(22) Filed: Nov. 14, 1997

(51) Int. Cl.[7] ..... A44B 19/00; E05B 67/38

(52) U.S. Cl. ..... 24/386; 24/381; 24/387; 70/68

(58) Field of Search ..... 24/386, 387, 381, 24/382, 383, 384, 385; 70/57, 68; 292/307 R

(56) References Cited

U.S. PATENT DOCUMENTS 2,398,947 A * 4/1946 Marinsky ..... 24/386
2,408,688 A * 10/1946 Schonthal ..... 24/387
3,210,971 A * 10/1965 Vandamme ..... 70/68
3,965,706 A * 6/1976 Davis ..... 70/68
4,790,156 A * 12/1988 Yang ..... 24/386
5,031,944 A * 7/1991 Keyaki ..... 24/387

FOREIGN PATENT DOCUMENTS

CA 0698325 * 11/1964 ..... 24/387
GB 0413825 * 7/1934 ..... 70/68

* cited by examiner

*Primary Examiner*—Victor N. Sakran
(74) *Attorney, Agent, or Firm*—Townsend and Townsend and Crew LLP

(57) ABSTRACT

A security for a compartmented structure including at least one zippered compartment includes a two-slide zipper. The pulls are configured to interlock one another and to expose a security slot when engaged. Affixing a security product to the security when the pulls are interlocked maintains the zippered compartment closed and secured. The security product preferentially includes a cable to secure the security product to an object other than the compartmented structure when affixed to the security slot to prevent unauthorized movement of the compartmented structure.

5 Claims, 2 Drawing Sheets

SECURITY ZIPPER PULL

CROSS-REFERENCE TO RELATED APPLICATIONS

This application is related to design patent application U.S. Ser. No. 29/079,559 filed Nov. 14, 1997 for SECURITY ZIPPER PULL which is incorporated herein by reference for all purposes.

BACKGROUND OF THE INVENTION

The present invention relates generally to security in zippered compartments, and more particularly to enhancement of security for notebook computer carrying cases using zippered compartments to store valuable equipment or documents.

FIG. 1 is a diagram of a conventional two pull zipper system 100. Zipper system 100 includes a zipper 105, a first zipper slide 110 and a second zipper slide 115. Zipper slide 110 and zipper slide 115 each include a zipper pull 120 having an aperture 125.

In conventional fashion, zipper system 100 is used in compartmented structures, for example garment bags, camera cases, book bags, suitcases, and computer carrying cases. The list of uses, past present and future, of zipper system 100 is extensive. Movement of zipper slide 110 to the left, in FIG. 1, and away from zipper slide 115 results in opening zipper 105. Similarly, movement of zipper slide 115 to the right also opens zipper 105. Moving zipper slide 110 and zipper slide 115 towards each other closes zipper 105. Apertures 125 provide, when the zipper slides are close enough to each other, a structure by which a user may maintain zipper 105 in the closed position. A user may place the U-shaped bar of a padlock, for example, through both apertures when the zipper slides are proximate each other. Locking the padlock results in securing zipper 105 closed. While the zipper slides remain locked together, zipper 105 secures the contents against unauthorized access.

While such a system offers some protection against unauthorized access to the contents of a zippered compartment, it is possible for an unauthorized user to remove the entire compartmented structure while the zippered compartment remains locked. Thereafter, the unauthorized user may defeat the security system out of sight of any authorized user.

The prior art has begun adopting use of a MICROSAVER® Security Lock for securing portable electronic devices such as laptop computers. These locks are commercially available from Kensington Technology Group of San Mateo, Calif. Exemplar locks are disclosed in several U.S. Patents, including COMPUTER EQUIPMENT LOCK, U.S. Pat. No. 5,327,752, COMPUTER PHYSICAL SECURITY DEVICE, U.S. Pat. No. 5,381,685, COMPUTER PHYSICAL SECURITY DEVICE, Ser. No. 08/138,634, filed Oct. 15, 1993, COMPUTER PHYSICAL SECURITY DEVICE, U.S. Pat. No. 5,502,989, COMPUTER PHYSICAL SECURITY DEVICE, U.S. Pat. No. 5,493,878, COMPUTER PHYSICAL SECURITY DEVICE, Ser. No. 08/462,324, file Jun. 5, 1995, COMPUTER PHYSICAL SECURITY DEVICE, Ser. No. 08/485,518, filed Jun. 7, 1995, COMPUTER PHYSICAL SECURITY DEVICE, Ser. No. 08/481,636, filed Jun. 7, 1995, COMPUTER PHYSICAL SECURITY DEVICE, Ser. No. 08/474,452, filed Jun. 7, 1995, COMPUTER PHYSICAL SECURITY DEVICE, Ser. No. 08/773,665, filed Dec. 24, 1996, COMPUTER PHYSICAL SECURITY DEVICE, Ser. No. 08/869,467, filed Jun. 5, 1997, SECURITY FASTENER, U.S. Pat. No. D347,987, SECURITY FASTENER, U.S. Pat. No. D346,733, COMPUTER PHYSICAL SECURITY DEVICE, Ser. No. 08/871,306, filed Jun. 9, 1997, COMPUTER PHYSICAL SECURITY DEVICE, Ser. No. 08/927,334, filed Sep. 11, 1997 and SECURITY DEVICE FOR A PORTABLE COMPUTER, Ser. No. 08/744,890 filed Nov. 8, 1996 all of which are hereby expressly incorporated by reference for all purposes. These locks permit a user to tether the portable electronic device to some other structure and to thereby inhibit the unauthorized relocation of the portable electronic device.

SUMMARY OF THE INVENTION

The present invention permits a user of a portable compartmented storage structure having a compartment secured by use of a zipper to both secure the compartment and secure the storage structure using the MICROSAVER® Security Lock, or other security product compatible with the Kensington® Security Slot standard. This solution permits those users having access to such a security product, such as those using the device in conjunction with a portable electronic device, to use the very same security product to secure the carrying case of the portable electronic device when the device is stored or ported inside the carrying case. Other users have the advantage of simply and efficiently securing any case using the same convenient security product.

According to one aspect of the invention, the security zipper includes a zipper having a first slide and a second slide; and a first zipper pull coupled to the first slide and a second zipper pull coupled to the second slide wherein the second zipper pull includes a pull-engaging slot for passing a distal end of the first zipper pull into and through the pull-engaging slot and wherein the first zipper pull includes a security slot at the distal end for receipt of a security device when the distal end extends into and through the pull-engaging slot of the second zipper pull.

The preferred embodiment of the invention also includes a method for securing a zipper of a compartmented structure, the zipper having a first slide and a second slide. The method includes the steps of passing a distal end of the first slide through a pull-engaging slot of the second slide to expose a security slot on the distal end of the first slide, the security slot including dimensions of about 3 mm by about 7 mm; and thereafter engaging a security device to the security slot wherein the security device includes a cable for attachment to an object other than the compartmented structure.

Reference to the remaining portions of the specification, including the drawing and claims, will realize other features and advantages of the present invention. Further features and advantages of the present invention, as well as the structure and operation of various embodiments of the present invention, are described in detail below with respect to accompanying drawing. In the drawing, like reference numbers indicate identical or functionally similar elements.

DESCRIPTION OF THE PREFERRED EMBODIMENT

Figure 2:
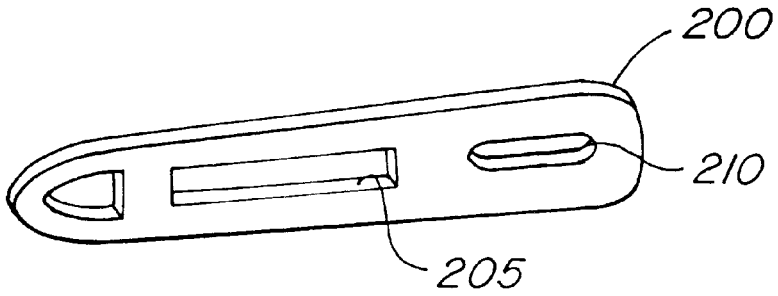
FIG. 2 is a diagram of a preferred embodiment of the present invention.

FIG. 2 is a diagram of a preferred embodiment of the present invention for a security zipper pull 200. Zipper pull

Figure 1:
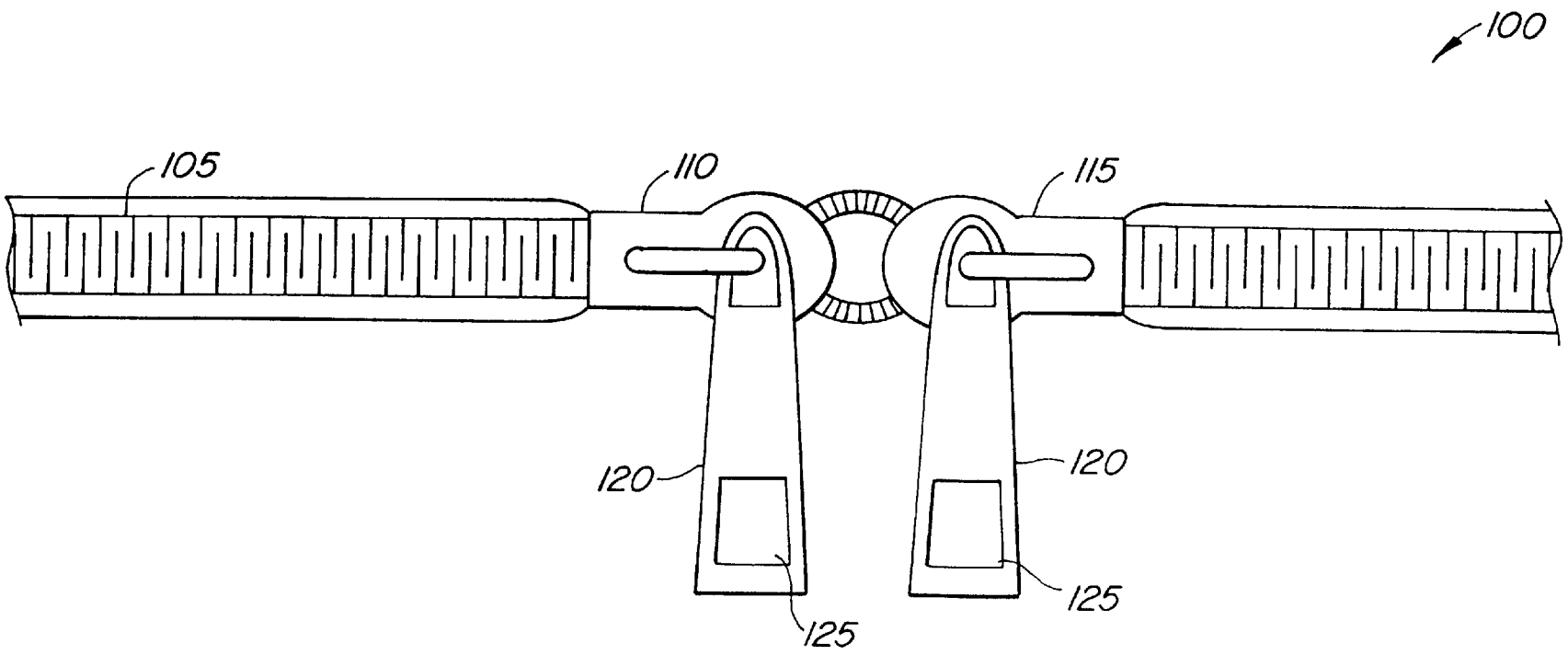
FIG. 1. (PRIOR ART)
FIG. 1 is an elevational view of a conventional two-pull zipper.

200, designed for use with a standard zipper slide such as zipper slide 110 shown in FIG. 1, includes a pull-engaging slot 205 and a security slot 210. In the preferred embodiment, slot 205 is dimensioned to receive a distal end of another pull, like pull 200, that is coupled to a proximate slide. The distal end may be passed through pull-engaging slot 205 when the slides, in the two-slide zipper, close the zipper. The distal end passes into and through pull-engaging slot 205 far enough to permit a user access to security slot 210. Security slot 210, in the preferred embodiment, conforms to the Kensington® Security Slot standard. The specifications for the slot are hereby expressly incorporated by reference for all purposes and are available from Kensington Microware Limited, San Mateo Calif. The slot, in this preferred embodiment, is about 3 mm by about 7 mm.

Figure 3:
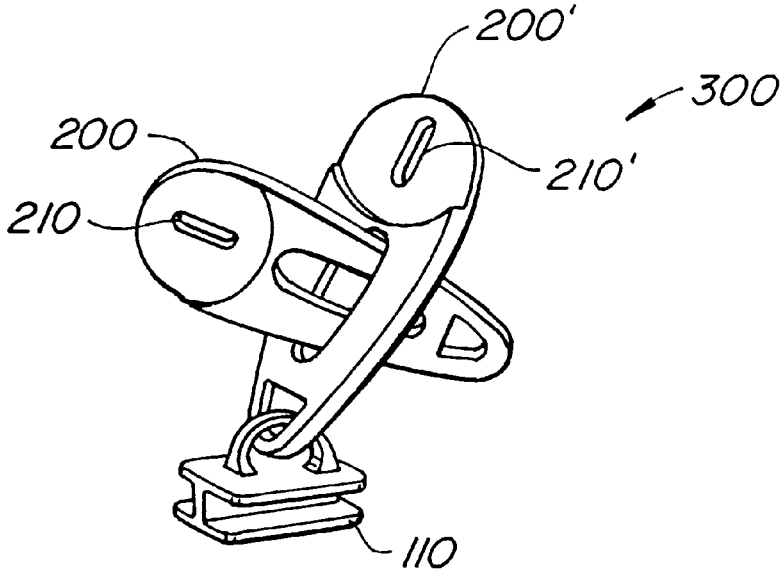
FIG. 3 is a diagram of the preferred embodiment for a security zipper pull interlocked with a second security zipper pull.

FIG. 3 is a diagram of the preferred embodiment for a two-zipper security system 300 including security zipper pull 200 interlocked with a second security zipper pull 200'. Second security pull 200' is shown coupled to a zipper slide while zipper pull 200 is not, though it is understood that both pulls are coupled to their respective slides. The security product engages security slot 210. Securing the security product to slot 210 maintains the pulls in the interlocked position. Hence, their respective slides are maintained proximate each other, holding the zipper in the locked position. In the preferred embodiment, the security product is one of the KENSINGTON® security products referenced earlier and disclosed in the incorporated references. Many of these products include a cable for securing the compartmented structure having a zippered compartment secured using the security zipper to an object other than the compartmented structure.

In conclusion, the present invention provides a simple, efficient cost-effective solution to locking compartmented structures. While the above is a complete description of the preferred embodiments of the invention, various alternatives, modifications, and equivalents may be used. For example, the preferred embodiment for a two-slide security zipper shown in FIG. 3 includes two virtually identical zipper pulls, it is possible that the pulls could be different. Only one pull requires a security slot and only one pull, the other pull, requires a pull-engaging slot. In another alternate embodiment, a single slide zipper could be used with the present invention. Locating an engaging tab or a locking tab proximate an end of the zipper where the slide rests when the zipper is closed permits the engaging tab/locking tab to interlock appropriately with the zipper pull and to be used to thereby secure the zipper in the locked position using a security slot in one of the structures. Therefore, the above description should not be taken as limiting the scope of the invention which is defined by the appended claims.

What is claimed is:

1. A security zipper, comprising:

a zipper having a first slide and a second slide; and a first zipper pull coupled to said first slide and a second zipper pull coupled to said second slide wherein said second zipper pull includes a pull-engaging slot for passing a distal end of said first zipper pull into and through said pull-engaging slot and wherein said first zipper pull includes a security slot at said distal end for receipt of a security device when said distal end extends into and through said pull-engaging slot of said second zipper pull.

2. The security zipper of claim 1 wherein said security slot is generally rectangular having dimensions of about 3 mm by about 7 mm.

3. The security zipper of claim 1, wherein the first zipper pull further includes a pull-engaging slot.

4. The security zipper of claim 1, wherein the second zipper pull further includes a security slot.

5. A method for securing a zipper of a compartmented structure, the zipper having a first slide and a second slide, comprising the steps of:

passing a distal end of the first slide through a pull-engaging slot of the second slide to expose a security slot on said distal end of the first slide, said security slot including dimensions of about 3 mm by about 7 mm; and thereafter engaging a security device to said security slot wherein said security device includes a cable for attachment to an object other than the compartmented structure.

* * * * *